US006532619B2

(12) United States Patent
Kasper et al.

(10) Patent No.: US 6,532,619 B2
(45) Date of Patent: Mar. 18, 2003

(54) EXTRACTION CLEANER AND AGITATOR THEREFOR

(75) Inventors: Gary A. Kasper, Grand Rapids, MI (US); Stefan G. Rider, Grand Rapids, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 0 days.

(21) Appl. No.: 09/681,826

(22) Filed: Jun. 12, 2001

(65) Prior Publication Data

US 2002/0026683 A1 Mar. 7, 2002

Related U.S. Application Data

(60) Provisional application No. 60/212,454, filed on Jun. 19, 2000.

(51) Int. Cl.[7] ..... A47L 9/00
(52) U.S. Cl. ..... 15/320; 15/383
(58) Field of Search ..... 15/320, 383, 141.2, 15/179, 182, 230.16

(56) References Cited

U.S. PATENT DOCUMENTS

| | | | | | |
|---|---|---|---|---|---|
| 1,476,004 | A | * | 12/1923 | Orr | 15/383 |
| 1,675,059 | A | | 6/1928 | Sharp | 15/383 |
| 1,740,525 | A | | 12/1929 | Tyson | 15/364 |
| 2,064,853 | A | | 12/1936 | Riebel, Jr. et al. | 15/383 |
| 2,064,856 | A | | 12/1936 | Riebel, Jr. | 15/366 |
| 2,407,408 | A | | 9/1946 | Erickson | 15/320 |
| 2,476,537 | A | | 7/1949 | Erickson | 15/383 |
| 2,523,823 | A | | 9/1950 | Grzelczyk | 15/141.2 |
| 3,597,789 | A | * | 8/1971 | Boyd | 15/383 |
| 4,250,592 | A | | 2/1981 | Emrick | 15/320 |
| 4,445,245 | A | | 5/1984 | Lu | 15/383 |
| 4,845,797 | A | * | 7/1989 | Kobayashi | 15/179 |
| 4,901,394 | A | | 2/1990 | Nakamura et al. | 15/383 |
| 5,029,361 | A | | 7/1991 | Murata et al. | 15/383 |
| 5,115,538 | A | * | 5/1992 | Cochran et al. | 15/383 |
| 5,611,109 | A | | 3/1997 | Wörwag | 15/386 |
| 6,167,587 | B1 | | 1/2001 | Kasper et al. | 15/320 |
| 6,367,120 | B2 | * | 4/2002 | Beauchamp | 15/320 |

FOREIGN PATENT DOCUMENTS

| | | |
|---|---|---|
| JP | 090187405 | of 1997 |
| JP | 100057285 | of 1998 |

OTHER PUBLICATIONS

Search Report Under Section 17(5), Dated Oct. 19, 2001.

* cited by examiner

*Primary Examiner*—Theresa T. Snider
(74) *Attorney, Agent, or Firm*—McGarry Bair PC

(57) ABSTRACT

According to the invention, a portable surface cleaning apparatus includes a fluid recovery system, a liquid dispensing system, and a rotatable agitation brush comprising a brush body and having a plurality of pliable agitation elements mounted along the brush body for contacting a surface to be cleaned. The agitation elements include a face extending along a length which is sufficient to draw the face across the surface to be cleaned as the brush body is rotated. The agitation elements are formed of elongated straps of fabric having a roughened or textured face and that can be formed of nylon knit strapping, synthetic felt, polyester velour, the loop portion of a hook-and-loop fastener system, pressed fiber material, microfiber polishing cloth, or reinforced synthetic fabric, or, in the alternative, formed of elongated fabric threads or string having a roughened or textured surface and formed of cotton roping or braided polyester threads.

15 Claims, 4 Drawing Sheets

EXTRACTION CLEANER AND AGITATOR THEREFOR

CROSS REFERENCE TO RELATED APPLICATIONS

This application claims the benefit of U.S. Provisional Application Serial No. 60/212,454, filed on Jun. 19, 2000.

BACKGROUND OF INVENTION

1. Field of the Invention

This invention relates to an extraction cleaner. In one of its aspects, the invention relates to an upright extraction-cleaning machine with an improved agitator. In another of its aspects, the invention relates to an agitator for an upright extraction-cleaning machine.

2. Description of the Related Art

Upright extraction-cleaning machines with rotatable agitation brushes are disclosed in U.S. Pat. No. 5,896,617, U.S. Pat. Application Ser. No. 09/072,446, filed May 4, 1998, and U.S. Provisional Patent Application Serial No. 60/188,575, filed Mar. 10, 2000, all of which are incorporated herein by reference. It is generally the tips of agitation bristles that impinge upon the surface to be cleaned.

The U.S. Pat. No. 4,901,394 to Nakamura et al. and the U.S. Pat. No. 1,740,525 to Tyson disclose vacuum cleaners with an agitator formed of flexible, continuous planar elements. The U.S. Pat. No. 1,675,059 to Sharp and the U.S. Pat. No. 2,523,823 to Grzelczyk disclose vacuum cleaners with an agitator formed of a plurality of flaps.

SUMMARY OF INVENTION

According to the invention, a portable surface cleaning apparatus a fluid recovery system comprising a tank having a fluid recovery chamber for holding recovered fluid, a suction nozzle, a working air conduit extending between the recovery chamber and the suction nozzle, a vacuum source in fluid communication with the recovery chamber for generating a flow of working air from the nozzle through the working air conduit and through the recovery chamber to thereby draw dirty liquid from the surface to be cleaned through the nozzle and working air conduit, and into the recovery chamber. A liquid dispensing system comprising a liquid dispensing nozzle for applying liquid to a surface to be cleaned, a fluid supply chamber for holding a predetermined amount of supply fluid and a fluid supply conduit fluidly connected to the fluid supply chamber and to the dispensing nozzle for supplying liquid to the dispensing nozzle. A rotatable agitation brush is associated with the suction nozzle is rotatably driven by a motor. The brush comprises a brush body and a plurality of pliable agitation elements mounted along the brush body for contacting a surface to be cleaned. The agitation elements include a face extending along their length, the length being sufficient to draw a substantial portion of the face across the surface to be cleaned as the brush body is rotated.

In one embodiment, the agitation elements are formed of elongated straps of fabric. The faces of these elongated straps can be roughened or textured. The straps can be formed of nylon knit strapping, synthetic felt, polyester velour, the loop portion of a hook-and-loop fastener system, pressed fiber material, microfiber polishing cloth, or reinforced synthetic fabric.

In another embodiment, the agitation elements are formed of elongated fabric threads or string. These threads or string can include a surface that is roughened or textured. The threads or string can be cotton roping or braided polyester threads.

BRIEF DESCRIPTION OF DRAWINGS

The invention will now be described with reference to the drawings wherein.

DETAILED DESCRIPTION

Figure 1:
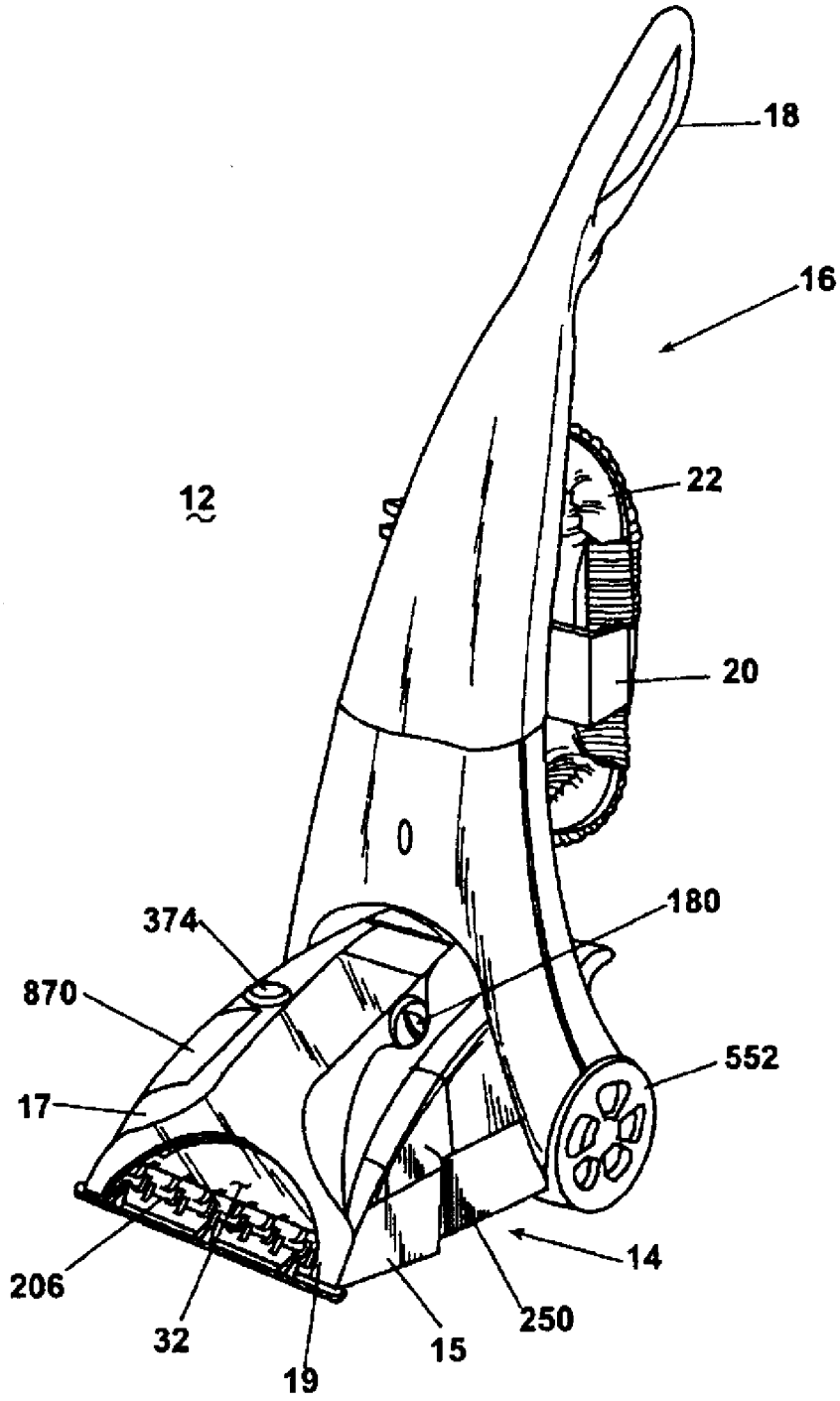
FIG. 1 is a perspective view of the upright extractor according to the invention.

Referring now to the drawings and to FIG. 1 in particular, the upright extraction cleaning machine 12 comprises a base module 14 adapted to roll across a surface to be cleaned on wheels 552, and an upright handle assembly 16 pivotally mounted to a rear portion of the base module 14. The base module 14 comprises a lower housing portion 15 and an upper housing portion 17, together defining an interior for housing components such as an agitator 206. The upright handle assembly 16 includes a closed loop grip 18 at an upper portion thereof and a cord and hose wrap 20 for carrying an accessory hose 22. The base module 14 further comprises a transparent facing 19 fixed to an upper portion of the of the upper housing portion 17, and a transparent panel 32 fixed to the lower housing portion 15 beneath and substantially parallel to the transparent facing 19.

Figure 2:
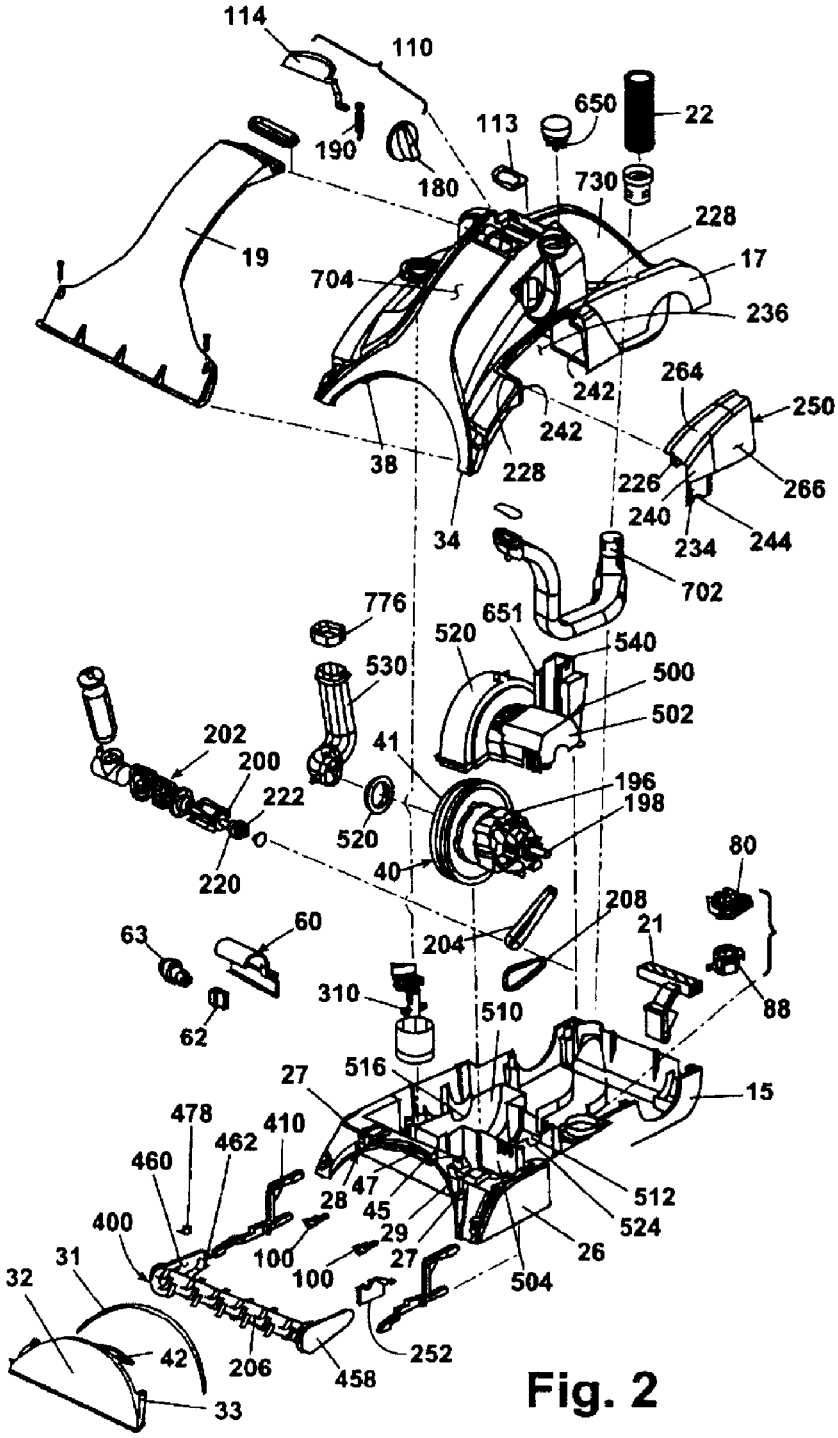
FIG. 2 is an exploded perspective view of the extractor of FIG. 1.
Figure 3:
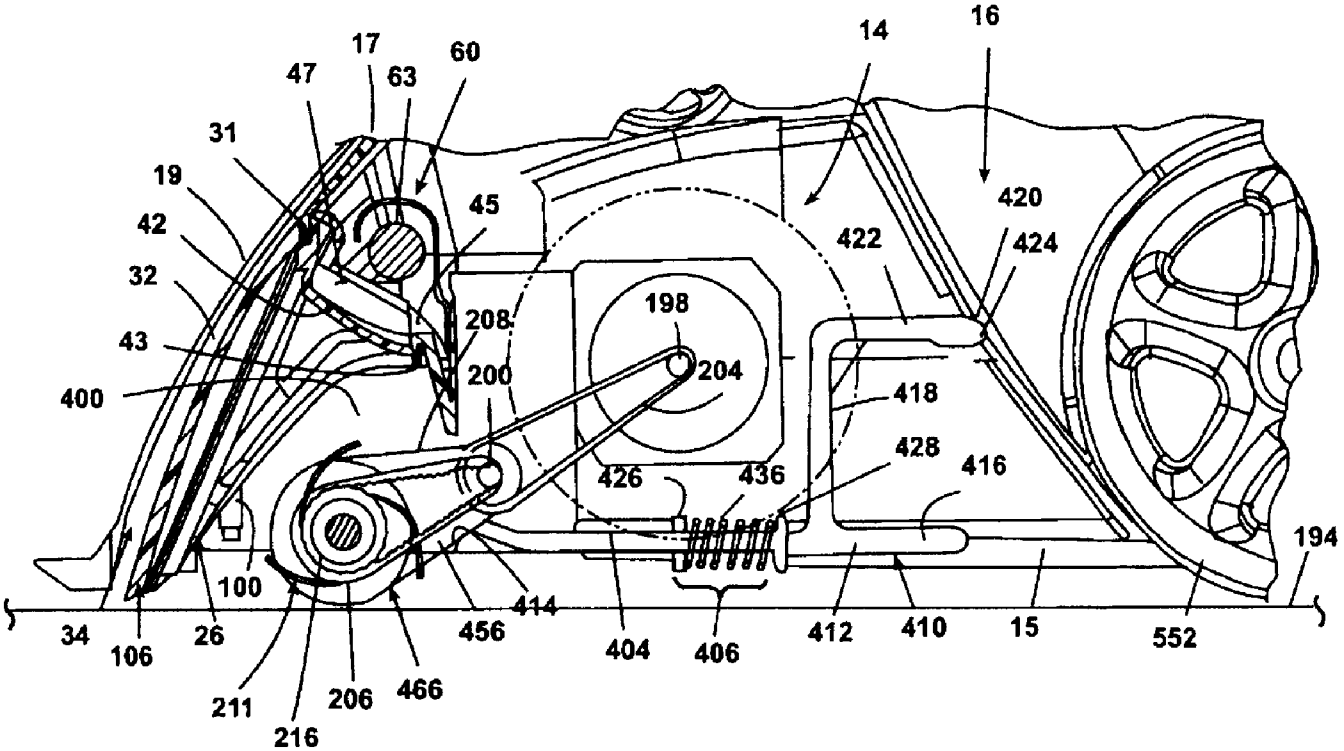
FIG. 3 is a partial cross-sectional view through the longitudinal centerline of the base of the extractor of FIGS. 1 and 2.

Referring to FIGS. 2 and 3, the lower housing portion 15 includes an agitator housing 26 at a front portion thereof for housing a rotatably driven agitator 206. The agitator housing 26 includes an arcuate opening 28 at a front portion thereof for receiving the transparent panel 32. The edge of the arcuate opening 28 substantially corresponds to the shape of the transparent panel 32. The transparent panel 32 is mounted to the agitator housing 26. The upper housing portion 17 has at a front portion thereof an arcuate edge 38 substantially conforming to the shape of the transparent panel 32 and conforming to the edge of the arcuate opening 28 of the agitator housing 26. Arcuate edge 38 mounts to a rim 29 formed at the junction of transparent panel 32 and arcuate opening 28 of agitator housing 26. The connection between the upper housing portion 17 and the rim 29 is made watertight by the inclusion of a rope gasket 31 therebetween. The upper housing portion 17 thus forms an interior face of a suction nozzle 34 in conjunction with the transparent panel 32. The transparent facing 19 is mounted in a watertight fashion over a working air conduit 704 formed in the upper face of the upper housing portion 17. The suction nozzle 34 fluidly connects the conduit 704 to the atmosphere at the surface to be cleaned. The transparent facing 19 thus forms the exterior wall of the conduit 704, and the exterior face of the suction nozzle 34. The suction nozzle 34 is therefore transparent, enabling the user to see through the front face of the base module 14 to the floor below the base module 14, and into the agitator housing 26 to see the agitator 206 contained therein, as well as to view the flow of fluid through the suction nozzle 34.

The transparent panel 32 is formed with a transparent lens 42 projecting from a rear portion thereof. The lens 42 has a lens edge 43 distal from the panel 32 that interfits with a lip 45 on the agitator.housing 26 to firmly seat the lens 42 on the agitator housing 26. The lens 42 is further aligned with and spans a lens opening 47 in an upper portion of the agitator housing 26 behind the front portion of the agitator housing 26. A heat shield 60 and a bulb socket 62 are mounted on the agitator housing 26, substantially aligned with the opening 47. A bulb 63 is mounted into the bulb socket 62. As electrical energy is applied selectively to the bulb 63, light from the bulb 63 passes through the opening 47 and lens 42. The bulb 63 thus illuminates the interior of the agitator housing 26, the agitator 206 mounted in the agitator housing 26, and the floor covered by the agitator housing 26. The bulb 63 and lens 42 are further configured within the upper portion of the, agitator housing 26 to further direct light toward the front portion of the housing 26 and thereby illuminate the suction nozzle 34 and the floor directly to the front of the suction nozzle 34 due to the transparency of transparent panel 32 and transparent facing 19.

The illuminated nozzle assembly provides the user with a viewable agitator 206 and illuminates the agitator 206 and the area being cleaned. Further, it provides the user a serviceable lightbulb 63 in that the lightbulb 63 is serviceable from beneath the base module 14. The transparent panel 32 is mounted to the agitator housing 26 by screws that extend through integrally molded bosses 33 on the transparent panel 32 and into threaded sockets 27 in the agitator housing 26.

The remainder of the features of the invention shown in FIGS. 1–3 but not described herein, are further disclosed in the specification and drawings contained in U.S. patent application Ser. No. 09/112,527 filed Jul. 8, 1998, now U.S. Pat. No. 6,167,587, issued Jan. 2, 2001, which is hereby incorporated by reference.

Figure 4:
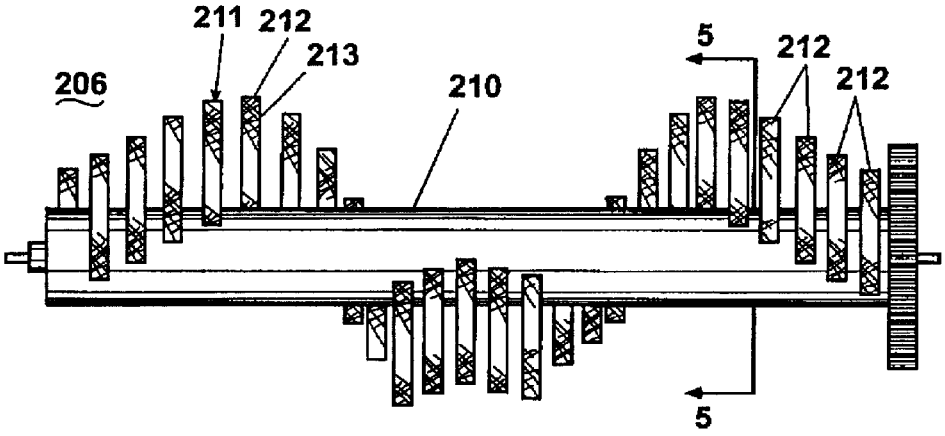
FIG. 4 is a front view of the agitator of FIGS.1–3.
Figure 5:
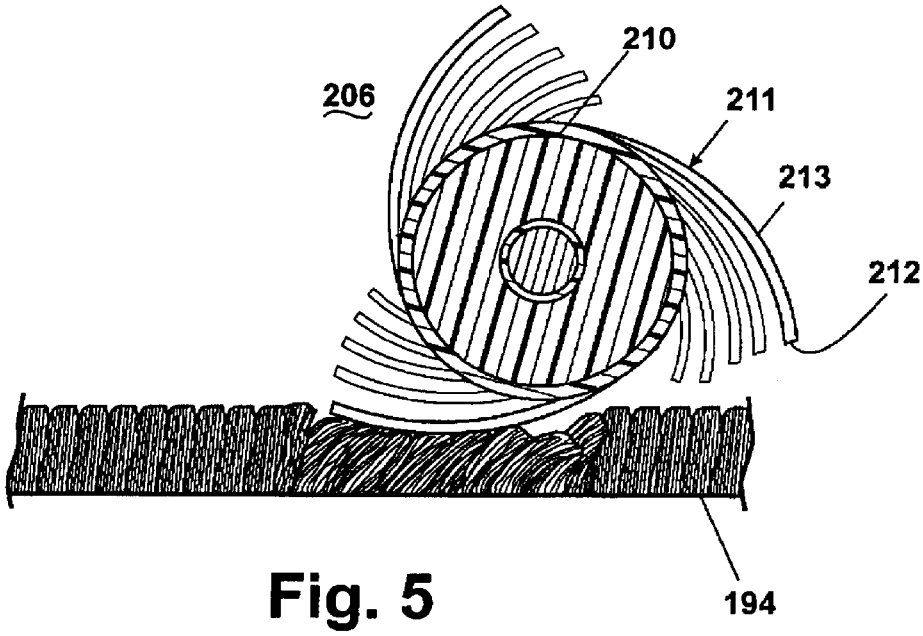
FIG. 5 is a cross-sectional view taken through line 5—5 of FIG. 4.

Referring now to FIGS. 4 and 5, agitator 206 comprises cylindrical.drum 210 and a plurality of pliable elements 211 affixed to drum 210 and projecting generally radially therefrom. Elements 211 are affixed to drum 210 in a generally symmetrical, helical pattern, seen best in FIG. 4, originating at each end of drum 210 and terminating at the center of drum 210. Each element 211 comprises an end 212 and a roughened or texture face 213.

FIG. 4 is a view of agitator 206 as it would be seen from the front of module 14. In operation, agitator 206 will typically rotate in a counterclockwise direction as seen in FIG. 5. As agitator 206 rotates, the helical arrangement of elements 211 will tend to draw debris and fluids from the surface of a carpet 194 and into suction nozzle 34.

In an unconfined or unconstrained environment, elements 211 would tend to extend radially from drum 210 during powered rotation of agitator 206 and may deflect radially rearwardly, depending on the weight and pliability of the elements 211. However, as agitator 206 rotates within agitator housing 26 adjacent to the surface of carpet 194, elements 211 are bent by the surface to be cleaned so that they wipe along the carpet surface. As agitator 206 rotates, the face 213 of each element 211 is urged toward the surface to be cleaned under the centripetal forces induced in elements 211 by the rotation of agitator drum 210. As each element. 211 is drawn across the surface to be cleaned, face 213 presses against the surface of the carpet 194 to be cleaned. Where the surface to be cleaned is a hard surface, such as a wood, vinyl or tile floor, the face 213 of each element 211 acts to physically dislodge soil from the surface. Where the surface to be cleaned is carpet, the face 213 of each element 211 first contacts the upper end of the carpet fibers, and draws the fibers in the direction of rotation of agitator 206. As each fiber is drawn by its initial contact with an element 211, the side of each fiber is exposed to contact with the remainder of roughened or textured face 213 of element 211, which continues to move in the direction of rotation of agitator 206. This extended agitating contact acts to dislodge soil and moisture from the fibers.

The elements 211 can be made of a variety of materials which can be selected to have appropriate properties of surface absorption, abrasiveness of the roughened or textured surface, and durability. These materials include nylon knit strapping, synthetic felt, polyester velours of various weights, cotton roping akin to mop string, braided polyester threads akin to a material fringe or tassel, the loop portion of a hook-and-loop fastener system, and pressed fiber material such as used in vacuum cleaner bags. Microfiber polishing cloth, or other reinforced synthetic fabrics are also anticipated as being adaptable for use in construction of elements 211.

The bristles of the conventional agitation brush only appreciably contact the surface to be cleaned for a shorter time, and with the smaller contact surface comprising the region proximate the bristle tip. Flexible elements 211 enhance the cleaning of any surface to be cleaned, and carpeted surfaces in particular, by extending the duration of contact and scrubbing action of roughened or textured face 213 against the body of the carpet fibers.

Reasonable variation and modification are possible within the spirit of the foregoing specification and drawings without departing from the scope of the invention.

What is claimed is:

1. A portable surface cleaning apparatus, comprising:

a base module for movement along a surface to be cleaned and comprising a base housing;

an upright handle pivotally mounted to the base housing;

a fluid recovery system comprising:

a tank having a fluid recovery chamber for holding recovered fluid;

a suction nozzle associated with the base module;

a working air conduit extending between the recovery chamber and the suction nozzle;

a vacuum source in fluid communication with the recovery chamber for generating a flow of working air from the nozzle through the working air conduit and through the recovery chamber to thereby draw dirty liquid from the surface to be cleaned through the nozzle and working air conduit, and into the recovery chamber;

a liquid dispensing system comprising:

a liquid dispensing nozzle associated with the base module for applying liquid to the surface to be cleaned;

a fluid supply chamber for holding a predetermined amount of supply fluid; and a fluid supply conduit fluidly connected to the fluid supply chamber and to the dispensing nozzle for supplying liquid to the dispensing nozzle; and a rotatable agitation brush associated with the base module and a motor for rotatably driving the brush, the brush comprising:

a brush body rotatably mounted to the base module;

a plurality of pliable agitation elements mounted along the brush body for contacting a surface to be cleaned, the agitation elements having a face extending along the length thereof; and the position of the brush body above the surface to be cleaned and the length and pliability of the pliable agitation elements are selected so that a substantial portion of the face of the pliable elements are drawn across the surface to be cleaned as the brush body is rotated.

2. The portable surface cleaning apparatus of claim 1 wherein the agitation elements are formed of elongated straps of fabric.

3. The portable surface cleaning apparatus of claim 2 wherein the face of the fabric straps is roughened or textured.

4. The portable surface cleaning apparatus of claim 2 wherein the elongated straps of fabric comprise nylon knit strapping.

5. The portable surface cleaning apparatus of claim 2 wherein the elongated straps of fabric comprise synthetic felt.

6. The portable surface cleaning apparatus of claim 2 wherein the elongated straps of fabric comprise polyester velour.

7. The portable surface cleaning apparatus of claim 2 wherein the elongated straps of fabric comprise the loop portion of a hook-and-loop fastener system mounted to the face of the agitation elements.

8. The portable surface cleaning apparatus of claim 2 wherein the elongated straps of fabric comprise pressed fiber material.

9. The portable surface cleaning apparatus of claim 2 wherein the elongated straps of fabric comprise microfiber polishing cloth.

10. The portable surface cleaning apparatus of claim 2 wherein the elongated straps of fabric comprise reinforced synthetic fabric.

11. The portable surface cleaning apparatus of claim 1 wherein the agitation elements are formed of elongated fabric threads or string.

12. The portable surface cleaning apparatus of claim 11 wherein the surface of the strings is roughened or textured along the length thereof.

13. The portable surface cleaning apparatus of claim 12 wherein the elongated fabric threads or string comprise cotton roping.

14. The portable surface cleaning apparatus of claim 12 wherein the elongated fabric threads or string comprise braided polyester threads.

15. A portable surface cleaning apparatus, comprising:

a fluid recovery system comprising:

a tank having a fluid recovery chamber for holding recovered fluid;

a suction nozzle;

a working air conduit extending between the recovery chamber and the suction nozzle;

a vacuum source in fluid communication with the recovery chamber for generating a flow of working air from the nozzle through the working air conduit and through the recovery chamber to thereby draw dirty liquid from a surface to be cleaned through the nozzle and working air conduit, and into the recovery chamber;

a liquid dispensing system comprising:

a liquid dispensing nozzle for applying liquid to the surface to be cleaned;

a fluid supply chamber for holding a predetermined amount of supply fluid; and a fluid supply conduit fluidly connected to the fluid supply chamber and to the dispensing nozzle for supplying liquid to the dispensing nozzle; and a rotatable agitation brush associated with the suction nozzle and a motor for rotatably driving the brush, the brush comprising:

a brush body;

a plurality of pliable agitation elements mounted along the brush body for contacting the surface to be cleaned, the agitation elements having a face extending along the length thereof; and the position of the brush body above the surface to be cleaned and the length and pliability of the pliable agitation elements are selected so that a substantial portion of the face of the pliable elements are drawn across the surface to be cleaned as the brush body is rotated.

* * * * *